US006558184B1

(12) United States Patent
Melocchi et al.

(10) Patent No.: US 6,558,184 B1
(45) Date of Patent: May 6, 2003

(54) CONNECTOR OF THE INSULATION-PERFORATING TYPE FOR A SUSPENDED ELECTRICAL SYSTEM

(75) Inventors: Mario Melocchi, Milan (IT); Valeria Osterwalder, Lugano (CH)

(73) Assignee: Electric & Lighting Engineering & Design Ltd., London (GB)

( * ) Notice: Subject to any disclaimer, the term of this patent is extended or adjusted under 35 U.S.C. 154(b) by 0 days.

(21) Appl. No.: 09/673,545

(22) PCT Filed: Apr. 22, 1999

(86) PCT No.: PCT/EP99/02839

§ 371 (c)(1),
(2), (4) Date: Feb. 9, 2001

(87) PCT Pub. No.: WO99/56353

PCT Pub. Date: Nov. 4, 1999

(30) Foreign Application Priority Data

Apr. 24, 1998 (IT) ..... MI98A0887

(51) Int. Cl.[7] ..... H01R 4/24; H01R 4/26; H01R 11/20

(52) U.S. Cl. ..... 439/419; 439/417

(58) Field of Search ..... 439/417, 419, 439/402, 405

(56) References Cited

U.S. PATENT DOCUMENTS 4,821,162 A * 4/1989 Ellis ..... 362/408
5,067,910 A 11/1991 Knox et al.
5,109,324 A * 4/1992 Ahroni ..... 362/249
5,339,232 A * 8/1994 Lin ..... 362/391
5,378,171 A * 1/1995 Czerlanis ..... 439/425
5,556,297 A * 9/1996 Bray et al. ..... 439/405
5,634,812 A 6/1997 Chen

FOREIGN PATENT DOCUMENTS

DE 4406042 8/1994
FR 2685982 7/1993

* cited by examiner

*Primary Examiner*—Brian Sircus
*Assistant Examiner*—Brian S. Webb
(74) *Attorney, Agent, or Firm*—Kalow & Springut LLP

(57) ABSTRACT

A connector of the insulation-perforating type for a suspended electrical system comprises conductive means for cutting an insulating covering of an insulated supply cable in order to connect an electrical device electrically to an uncovered portion of the supply cable, and an insulating structure for enclosing the conductive means, in which the insulating structure includes a first insulating element which can be closed around the supply cable in a non-reversible manner in order to protect the uncovered portion from manual contact, and a second insulating element which can be connected to the electrical device and which can be joined reversibly to the first insulating element, the first insulating element comprising means for preventing sliding along the supply cable.

10 Claims, 4 Drawing Sheets

CONNECTOR OF THE INSULATION-PERFORATING TYPE FOR A SUSPENDED ELECTRICAL SYSTEM

The present invention relates to a connector of the insulation-perforating type for a suspended electrical system.

Suspended electrical systems (or cable systems) are constituted by electrical devices (typically lighting devices) supported and supplied by insulated supply cables stretched, for example, between two walls. The devices are connected electrically to each supply cable by means of suitable insulation-perforating connectors.

Known connectors are generally constituted by an insulating body which is closed around a portion of the supply cable and in a side portion of which a free end of an insulated branch cable of the electrical device is inserted. A metal blade is forced into a slot in the insulating body so as to cut an insulating covering of the supply cable and of the branch cable and thus to establish an electrical contact between the two cables; the slot in which the metal blade is inserted is then covered by an insulating protection element which can be reopened.

A disadvantage of known connectors is that they can easily be opened in order to be moved to a different position along the supply cable. In this situation, the portion of the supply cable in which the connector was previously positioned is not insulated because its covering has been cut by the metal blade. This creates a dangerous situation and a serious risk in the event of accidental contact with the supply cable.

The object of the present invention is to overcome the above-mentioned drawbacks. To achieve this object, a connector as described in the first claim is proposed.

In short, a connector of the insulation-perforating type for a suspended electrical system is provided and comprises conductive means for cutting an insulating covering of an insulated supply cable in order to connect an electrical device electrically to an uncovered portion of the supply cable, and an insulating structure for enclosing the conductive means, the insulating structure including a first insulating element which can be closed around the supply cable in a non-reversible manner in order to protect the uncovered portion from manual contact, and a second insulating element which can be connected to the electrical device and which can be joined reversibly to the first insulating element, the first insulating element comprising means for preventing sliding along the supply cable.

An electrical device comprising the connector, a suspended electrical system comprising the device, and a corresponding connection method are also proposed.

Figure 1:
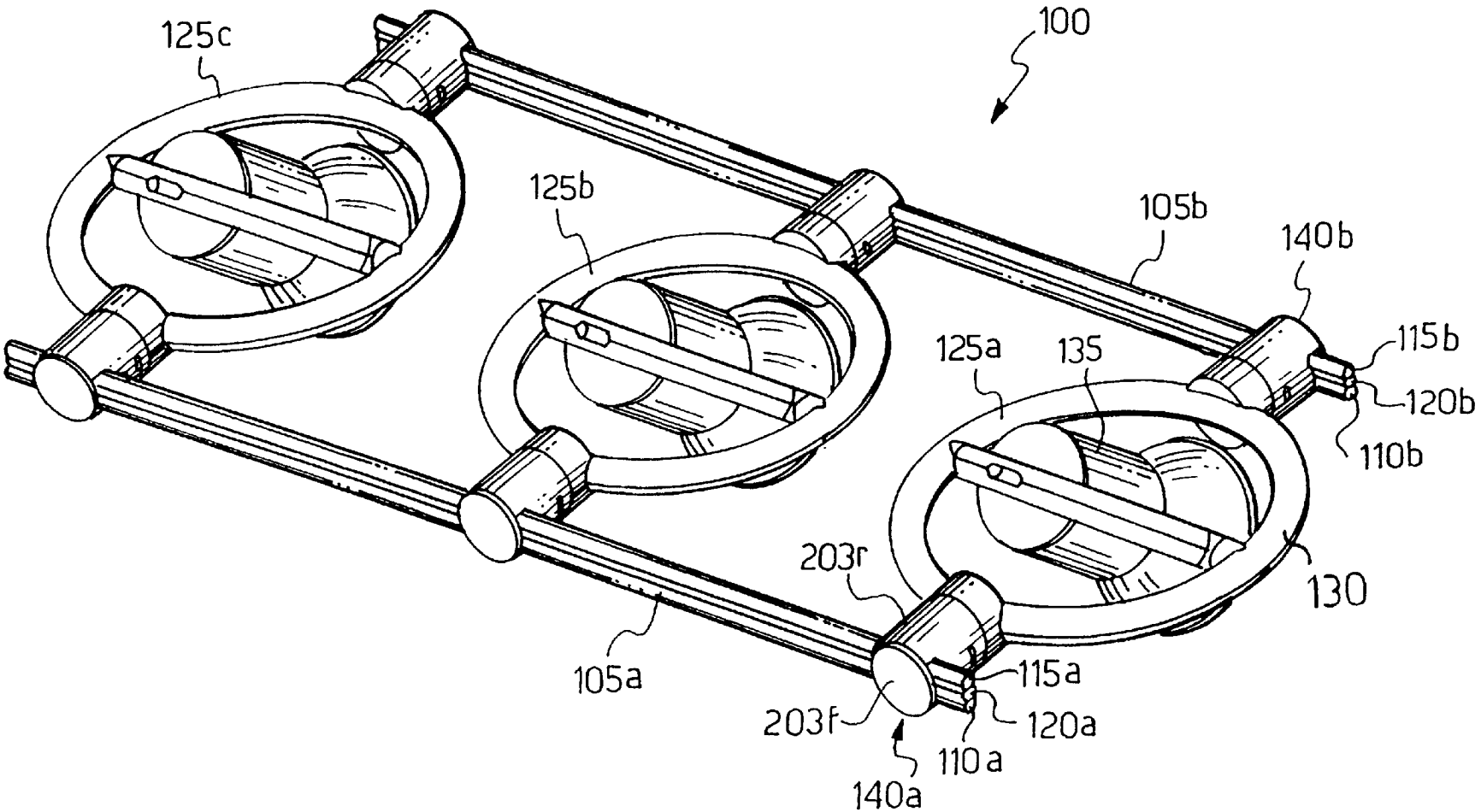
Figure 2:
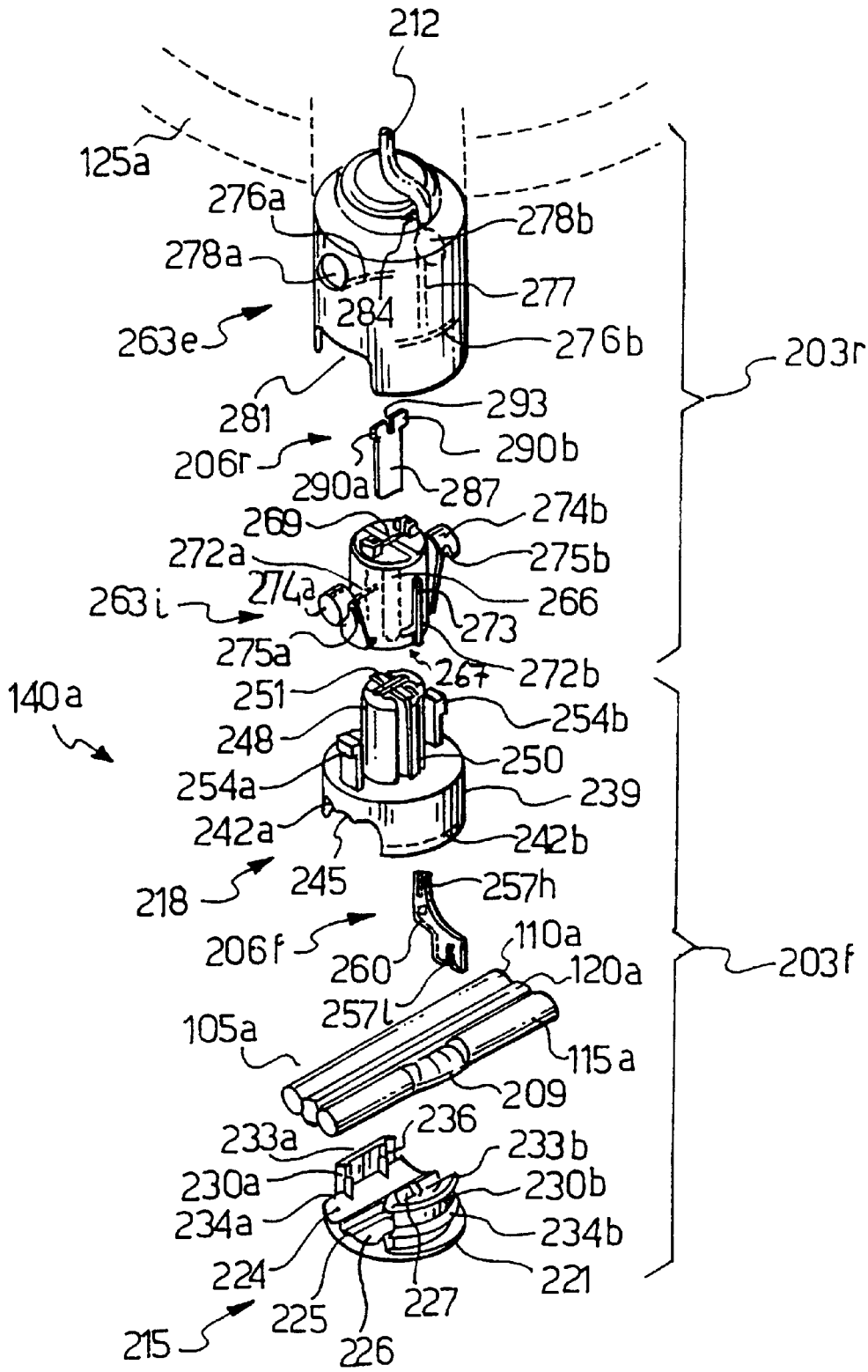
Figure 3:
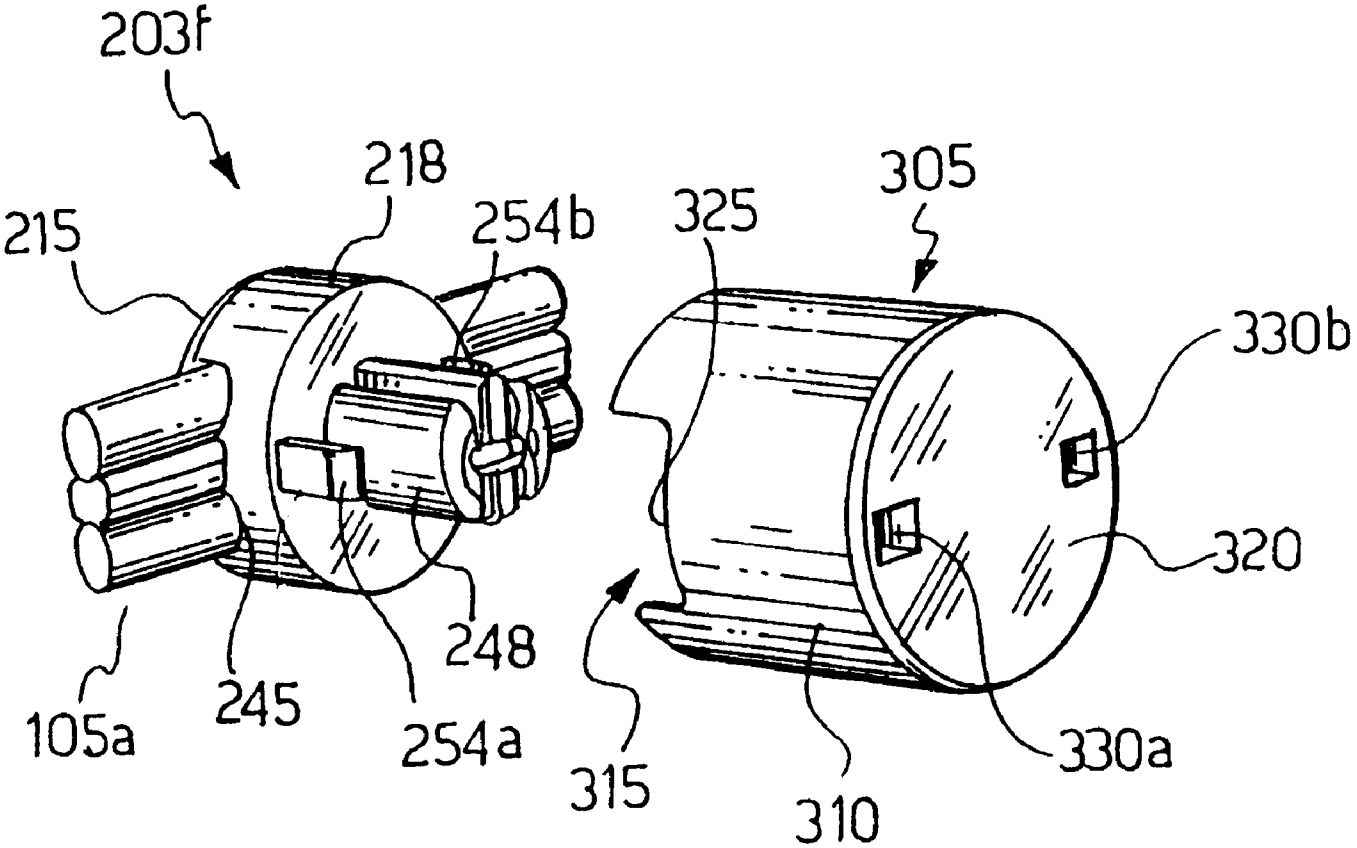
Figure 4:
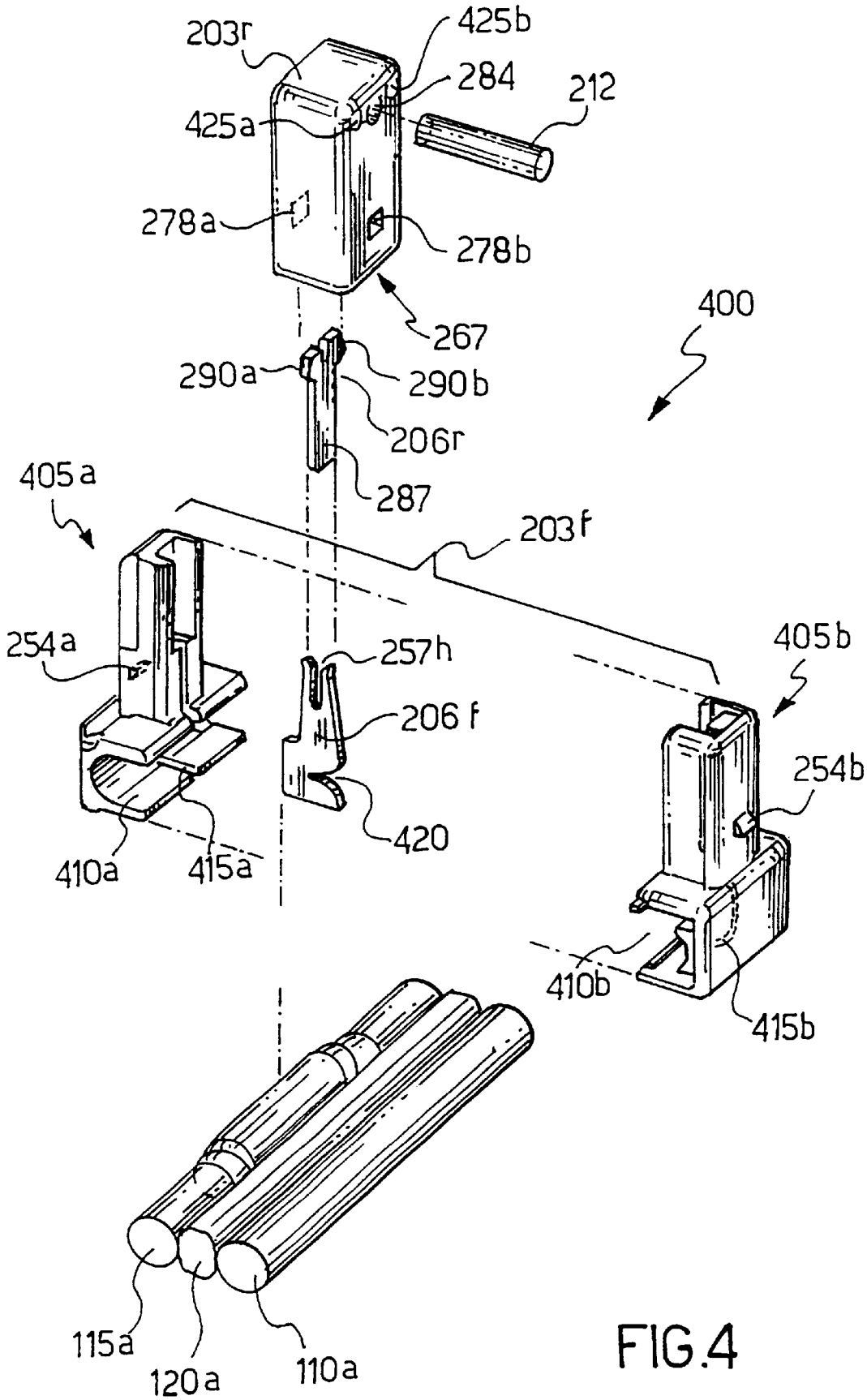

Further characteristics and the advantages of the connector according to the invention will become clear from the following description of a preferred embodiment thereof, given by way of non-limiting example, with reference to the appended drawings, in which FIG. 1 shows a suspended electrical system in which the connector of the present invention can be used, FIG. 2 is a view of the connector with parts separated, FIG. 3 shows an accessory used for the assembly of the connector, FIG. 4 shows a variant of the connector.

With reference in particular to FIG. 1, a suspended electrical system 100 is formed by two parallel cable structures 105*a* and 105*b* which are stretched horizontally between two walls (not shown in the drawing). Each cable structure 105*a,* 105*b* includes two supply cables, 110*a,* 115*a* and 110*b,* 115*b,* respectively. Each of the cables 110*a,* 115*a,* 110*b,* 115*b* is supplied at low voltage, for example, at between 110V and 240V, and is covered by a double insulation sheath. Support cables 120*a* and 120*b,* also covered by a double insulation sheath, are disposed between the supply cables 110*a* and 115*a* and between the supply cables 110*a* and 115*b,* respectively.

Three electrical devices 125*a,* 125*b,* 125*c,* for example, three lamps, are connected between the cable structures 105*a* and 105*b*. The lamps 125*a*–125*c* are supported mechanically by the support cables 120*a,* 120*b* and each is connected electrically to one of the supply cables 110*a,* 115*a* and to one of the supply cables 110*b,* 115*b,* in a manner such that it can be lit separately.

The lamp 125*a* (similar remarks apply to the other lamps 125*b*–125*c*) is constituted by a toroidal load-bearing element 130, made, for example, of metal, on which is mounted a halogen light 135 orientable about an axis parallel to the cable structures 105*a,* 105*b*. The lamp 125*a* is connected electrically to the supply cable 115*a* and to the supply cable 115*b* by means of connectors indicated 140*a* and 140*b,* respectively.

Similar remarks apply if the cable structures are stretched between a ceiling and a floor, if each cable structure includes a different number of supply cables (or even only one), if a different number of insulating sheaths (or even only one) is provided, if a different supply voltage is used, if no support cable is provided (with the electrical devices supported directly by the supply cables), if the lamps have a different structure, if other electrical devices such as loudspeakers, fans, smoke detectors, infra-red switches, are used, etc.

With reference now to FIG. 2, the connector 140*a* (similar remarks apply to the other connector 140*b*) has an insulating structure (made, for example, of plastics material) formed by a fixed element 203*f* and by a removable element 203*r*. The insulating structure 203*f,* 203*r* encloses two metal blades 206*f* and 206*r* (made, for example, of tinned copper alloy). The connector 140*a* is of the insulation-perforating (or "self-stripping") type in which the metal blade 206*f* cuts an insulating covering of the supply cable 115*a* in order to make electrical contact with an uncovered portion 209 thereof; similarly, the metal blade 206*r* cuts an insulating covering of a branch cable 212 of the lamp 125*a* in order to make electrical contact with an uncovered portion thereof.

As described in detail below, the insulating element 203*f* is closed around the supply cable 115*a* (and the metal blade 206*f*) in a non-reversible manner; the insulating element 203*f* is clamped on the supply cable 115*a* so as not to be able to slide along it. This insulating element 203*f* protects the uncovered portion 209 from any manual contact (either direct or via the metal blade 206*f*). The insulating element 203*r* houses a free end of the branch cable 212 including the uncovered portion which is connected to the metal blade 206*r*. The insulating element 203*r* is joined to the insulating element 203*f* in a manner such that the metal blade 206*r* comes into contact with the metal blade 206*f,* connecting the lamp 125*a* electrically to the supply cable 115*a*; this operation is reversible so that the insulating element 203*r* (and hence also the metal blade 206*r* fixed thereto and connected to the branch cable 212) can be removed, disconnecting the lamp 125*a* from the supply cable 115*a*.

Similar remarks apply if the branch cable extends through the insulating structure in order to supply two lights in parallel, if the lamp is connected to the metal blade in a different manner, or if a single metal blade or other equivalent conductive means are provided.

The connector according to the present invention allows the electrical device to be removed from the suspended system without any risk. The insulating element 203*f* in fact always remains closed around the uncovered portion 209 of the supply cable 115*a* and can be neither removed nor displaced from this position; the removal of the electrical device does not therefore uncover the portion of the supply cable in which the insulating covering has been cut, so that any risk of accidental contact with live elements is prevented. The fact that the insulating element 203*f* cannot slide along the supply cable 115*a* is also particularly advantageous during the installation of the lamp 125*a* if the supply cable 115*a* is not arranged horizontally, since the insulating element 203*f* is prevented from sliding downwards.

The insulating element 203*f* which has remained closed around the supply cable 115*a* can also be reused (but not removed) for connecting other electrical devices, allowing the structure of the suspended electrical system to be modified extremely easily but with maximum safety. For example, a series of pairs of insulating elements may be provided, suitably spaced along two cable structures, so as to render the arrangement of the various electrical devices very practical and flexible.

In the embodiment shown in the drawing, the insulating element 203*f* is formed by a base 215 which is closed at the top (that is, along a minor transverse axis of the cable structure 105*a*) by a cover 218. The base 215 is constituted by a disk 221 in the top of which there are three longitudinal channels 224, 225 and 226 which house the supply cable 110*a*, the support cable 120*a*, and the supply cable 115*a*, respectively. A sharpened wall 227, which is shaped as a cutting and opening-out finger-nail (or other equivalent means) is disposed between the channel 225 and the channel 226. A resilient (straight) wall 230*a* and a resilient (arcuate) wall 230*b* extend upwards from outer side edges of the channel 224 and of the channel 226, respectively. Each resilient wall 230*a*, 230*b* has an upper engagement tooth 233*a*, 233*b* and a lower engagement tooth 234*a*, 234*b*. One or more cable-gripping ribs 236 are formed on an inner surface of the resilient wall 230*a*.

The cover 218 is constituted by a cylinder 239 having a lower cavity in which there are two lateral channels 242*a* and 242*b*, each having a bearing surface mating with the engagement teeth 233*a*, 234*a* and 233*b*, 234*b*, respectively. Along a lower edge of the cylinder 239 there are two notches 245 (only one of which is shown in the drawing) corresponding to the cable structure 105*a*. A tower 248 extending upwards from an upper end of the cylinder 239 has longitudinal grooves 250 formed on a side surface; a slot 251 extends through the tower 248 as far as the lower cavity of the cylinder 239. Two engagement teeth 254*a* and 254*b* are disposed on the upper end of the cylinder 239 beside the tower 248 in symmetrical positions relative thereto.

The metal blade 206*f* has a downwardly-facing, U-shaped opening 257*l* and an upwardly-facing U-shaped opening 257*h*; the openings 257*h* and 257*l* are not aligned with one another and are thus arranged on the longitudinal axes of the connector 140*a* and of the supply cable 115*a* (or of the supply cable 120*a* if the metal blade 206*f* is rotated through 180° relative to the longitudinal axis of the connector), respectively. A clamping hole 260 is formed in the metal blade 206*f* beneath the opening 257*h*. The metal blade 206*f* is inserted into the cover 218 from below until the opening 257*h* is fitted in a lower portion of the slot 251 and is locked in this position by a punching burr of the hole 260 which interferes with an inner lateral surface of the slot 251. The opening 257*l* projects downwards from the slot 251 into the lower cavity of the cylinder 239.

The insulating element 203*r* is formed by an inner cylinder 263*i* and an outer cylinder 263*e*. The inner cylinder 263*i* has a lower cavity 267 having ribs 266 complementary to the grooves 250. A slot 269 is formed in an upper end of the inner cylinder 263*i* for access to the cavity 267. On a lateral surface of the inner cylinder 263*i* there are two projections 272*a* and 272*b* disposed in the vicinity of a lower rim of the inner cylinder 263*i* and two longitudinal strips 273 (of which only one is shown in the drawing). Two outer resilient tabs extend upwardly from the lower rim of the inner cylinder 263*i*, and each terminates in a button 274*a*, 274*b*; two recesses 275*a* and 275*b* complementary to the engagement teeth 254*a* and 254*b*, respectively, are formed beneath the corresponding buttons 274*a* and 274*b*.

The outer cylinder 263*e* has a lower cavity (matching the inner cylinder 263*i*) in which there are two lateral grooves 276*a* and 276*b*, complementary to the corresponding projections 272*a* and 272*b* and longitudinal grooves 277 (having self-centring lead-in openings) complementary to the strips 273. On a lateral wall of the outer cylinder 263*e*, there are two holes 278*a* and 278*b* for the buttons and the corresponding engagement teeth 274*a*, 254*a* and 274*b*, 254*b*, respectively. Two notches 281 (of which only one is shown in the drawing), corresponding to the cable structure 105*a*, are formed along a lower rim of the outer cylinder 263*e*. In the vicinity of an upper end of the outer cylinder 263*e* there is a blind hole 284 for the free end of the branch cable 212 which has an intermediate portion (not shown in the drawing) in communication with the lower cavity of the outer cylinder 263*a*.

The metal blade 206*r* is T-shaped with a main body 287 from which two upper arms 290*a* and 290*b* extend. Between the two arms 290*a* and 290*b* there is an upwardly-facing U-shaped opening 293.

In an operative condition, the base 215 is placed against the cable structure 105*a* in the position in which the lamp 125*a* is to be installed. The sharpened wall 227 enables the supply cable 115*a* to be separated automatically from the support cable 120*a* without the need for any preliminary operation to cut and open out the cable structure 105*a*.

The cover 218 is then placed against the base 215 and is forced against it until the upper engagement teeth 233*a*, 233*b* are snap-fitted in the grooves 242*a*, 242*b*. The different shapes of the resilient walls 230*a* and 230*b* facilitate the correct positioning of the cover 218 relative to the base 215 (similar remarks supply if the base and the cover have a different asymmetric shape) The cover 218 is thus temporarily engaged on the base 215 extremely easily. The cover 218 and the base 215 do not therefore need to be held together during the subsequent operations (described below) to assemble the connector; the lamp 125*a* can thus be installed easily and safely, even in unstable conditions.

With reference now to FIG. 3 (elements already shown in FIG. 2 are identified by the same reference numerals) the cover 218 is fixed finally to the base 215 with the use of an assembly accessory 305. The accessory 305 is constituted by a cylinder 310 in which there is a cavity 315 complementary to a lateral surface of the insulating element 203*f* and closed by an end portion 320; along a free rim of the cylinder 310 there are two notches 325 (of which only one is shown in the drawing) corresponding to the cable structure 105*a*. Two holes 330*a* and 330*b* are also formed in the end portion 320 for the engagement teeth 254*a* and 254*b* of the cover 218, respectively.

The accessory 305 is fitted on the cover 218 until an end of the tower 248 abuts the end portion 320. If the base 215 and the accessory 305 (which contains the cover 218) are pressed together, for example, by pincers, the lower engagement teeth of the base 215 (indicated 234*a*, 234*b* in FIG. 2)

are snap-fitted in the corresponding grooves of the cover 218, clamping the cover 218 finally on the base 215. The engagement teeth 254*a,* 254*b* are forced into the holes 330*a,* 330*b,* keeping the accessory 305 connected to the insulating element 203*f.* The accessory 305 is then removed manually by being slipped off the insulating element 203*f* (simply by pulling).

The accessory 305 described above facilitates the assembly of the insulating element 203*f* and ensures that the coupling between the base 215 and the cover 218 take place in the correct direction so as to prevent any damage thereto. Moreover, if the electrical device should be removed, the accessory 305 can be mounted on the insulating element 203*f* (being held in position by the engagement teeth 254*a,* 254*b* forced into the holes 330*a,* 330*b*), improving the appearance of the suspended electrical system.

With further reference to FIG. 2, the clamping of the cover 218 on the base 215 is not reversible since the engagement teeth 234*a,* 234*b* are not accessible from the exterior so that it is not possible to open the insulating element 203*f* by a non-destructive method. During the above-described operation, the cable structure 105*a* is forced into the notches 245 and against the ribs 236 so as to prevent any sliding of the insulating element 203*f* along the cable structure 105*a*. At the same time, the opening 257*l* bears against the supply cable 115*a* and, when the cover 218 is forced against the base 215, the opening 257*l* cuts the insulating covering of the supply cable 115*a* (with deformation of plastics material which is disposed in suitable relief grooves, not shown in the drawing); an internal conductor of the supply cable 115*a* is urged under pressure into the opening 257*l* so as to be in electrical contact with the metal blade 206*f.* The metal blade 206*f* is arranged inside the insulating element 203*f.* The limited dimensions of the slot 251 prevent the metal blade 206*f* from being touched from the exterior. Moreover, the height of the tower 248 and the width of the tower 248, together with the limited dimensions of the grooves 250, ensure that the distance of the metal blade 206*f* from any point accessible manually from the exterior (the air gap) is sufficiently large; this distance has a value, for example, no less than 6.5 mm, such as to prevent an electrical current due, for example, to air pollution (such as dust, moisture or the like) from accidentally being transmitted between the metal blade 206*f* and a person's finger, so as to form a so-called enhanced insulation.

The above-described structure is particularly simple and effective. Alternatively, the base and the cover are constituted by other equivalent units (of different, possibly symmetrical shapes, and without a sharpened wall), no system is provided for temporarily joining the cover to the base, the element is assembled without assembly accessories, the insulating element has other equivalent means for preventing sliding along the cable structure, the engagement teeth are provided on the cover and the corresponding grooves on the base, or pins with conical heads inserted in corresponding holes or other equivalent snap-closure means, non-removable screws (with unidirectional shearing or predetermined fracture), are used, etc.

The metal blade 206*r* is fitted in the slot 269 from above until the arms 290*a,* 290*b* abut the upper end of the inner cylinder 263*i.* The free end of the branch cable 212 is inserted fully into the blind hole 284. The inner cylinder 263*i* is fitted in the lower cavity of the outer cylinder 263*e* (guided by the strips 273 which slide along the grooves 277) until the opening 293 bears against the branch cable 212. If the inner cylinder 263*i* is forced into the outer cylinder 263*e,* the opening 293 cuts the insulating covering of the branch cable 212 (with deformation of plastics material which is disposed in suitable relief grooves, not shown in the drawing); an internal conductor of the branch cable 212 is urged under pressure into the opening 293 so as to be in electrical contact with the metal blade 206*r.* At the same time, the projections 272*a,* 272*b* are inserted in the grooves 276*a,* 276*b,* snap-locking the inner cylinder 263*i* irreversibly (whilst the buttons 274*a,* 274*b* are inserted in the holes 278*a,* 278*b*).

In the above-described structure, the metal blade 206*r* (once it is electrically connected to the branch cable 212) is disposed inside the insulating element 203*r*; the fact that the metal blade 206*r* is not as tall as the inner cylinder 263*i* and the presence of the ribs 266 prevent the metal blade 206*r* from being touched from the exterior and ensure the correct air gap and the corresponding enhanced insulation. This characteristic further increases the safety of the connector 140*a* since it prevents any accidental contact with the metal blade 206*r* which could be particularly dangerous if another end of the lamp 125*a* were connected to a live supply line. Moreover, the metal blade 206*r* is irremovable and the branch cable 212 cannot be removed from the insulating element 203*r*, so that a particularly practical unit is formed. The above-described operations are performed in the factory during the assembly of the lamp 125*a* although the possibility of their being performed directly on the spot, immediately before the lamp 125*a* is installed, is not excluded.

Moreover, the double structure of the insulating element 203*r* is particularly safe since it locks the metal blade 206*r* in the insulating element 203*r* absolutely irremovably.

Similar remarks apply if the metal blades have a different structure and are housed in cavities of different shapes in order to be protected from manual contact and to ensure the correct air gap (or purely to be protected from manual contact), if differently shaped inner and outer elements are used, if the two elements are joined together in another manner (possibly reversibly), if the outer element covers only the access slot in which the metal blade is inserted, etc. The connector of the present invention may in any case also be formed with the insulating element connected to the branch cable constituted by a single body, or with a single metal blade connected to the branch cable and projecting from the corresponding insulating element. In this case, the insulating element closed around the supply cable has a narrow slot in which the metal blade is fitted. During the installation of the lamp, the metal blade cuts the supply cable so as to connect the branch cable electrically thereto; when the insulating element connected to the branch cable is removed, pulling with it the metal blade firmly fixed thereto, the uncovered portion of the supply cable remains protected by the insulating element which is closed around it.

With further reference to the connector shown in the drawing, at this point the insulating element 203*r* is fitted on and forced against the insulating element 203*f* (guided by the ribs 266 which slide along the grooves 250); the engagement teeth 254*a,* 254*b* are fitted between the inner cylinder 263*i* and the lateral wall of the outer cylinder 263*e* until they reach the recesses 275*a,* 275*b* and are snap-fitted in the holes 278*a,* 278*b*. At the same time, the main body 287 of the metal blade 206*r* is fitted in the slot 251 and is thus fitted in the opening 257*h* of the metal blade 206*f* (transversely relative thereto) so as to connect the branch cable 212 of the lamp 125*a* electrically to the supply cable 115*a* (similar remarks apply if the metal blade 206*f* is fitted in the cavity which houses the metal blade 206*r*). In this situation, the metal blades 206*f,* 206*r* are completely enclosed by the insulating structure 203*f,* 203*r* and are not accessible in any way from the exterior and thus ensure the correct air gap and the corresponding enhanced insulation. The insulating element 203*r* can easily be removed by manually pressing the buttons 274*a,* 274*b* which urge the engagement teeth 254*a,* 254*b* inwards, releasing them from the holes 278*a,* 278*b;* at this point, it suffices to withdraw the insulating element 203*r* which also pulls with it the metal blade 206*r* firmly fixed thereto.

Similar remarks apply if the insulating elements are of another shape, if there is a different number of engagement teeth (or even only one), or if the teeth are formed on the element connected to the branch cable, if other equivalent resilient elements are provided, etc. This structure enables the insulating elements to be joined and separated in a very practical and safe manner and can be mass-produced at low cost. In particular, the above-described buttons enable the engagement teeth to be released from the corresponding holes without the use of any tools. Alternatively, the engagement teeth are released by the tip of a screwdriver (without any buttons), other equivalent snap-closure means are used, the insulating elements are joined together simply by pressure, by means of fixing screws, etc.

With further reference to FIG. 1, the insulating element 203*r* of the connector 140*a* (similar remarks apply to the connector 140*b*) forms an integral part of the load-bearing structure 130 which supports the lamp 125*a*. This renders the installation of the lamp 125*a* extremely quick and easy; in fact, once the insulating elements have been closed around the cable structures 105*a* and 105*b,* it suffices to pull them apart slightly and to snap-connect the corresponding insulating elements included in the load-bearing structure 130. Similar remarks apply if the insulating elements included in the load-bearing structure of the lamp are disposed outside the two cable structures (so that they have to be moved towards one another during the installation of the lamp) if the connectors are covered by a protective screen of the lamp, etc. The connector of the present invention may also be used in other electrical devices, possibly without being an integral part of their load-bearing structure (but simply enclosed therein).

In a different embodiment of the present invention, as shown in FIG. 4, (elements structurally and functionally similar to those shown in FIG. 2 are identified by the same reference numerals and their explanation is omitted for simplicity of description) a connector 400 is provided in which the insulating element 203*f* is constituted by two half-shells 405*a,* 405*b* joined together along a major transverse axis of the cable structure 105*a*. Respective channels 410*a* and 410*b* are defined in the half shells 405*a* and 405*b;* when the half-shells 405*a,* 405*b* are joined together, the channels 410*a,* 410*b* define a tubular structure which houses the supply cable 115*a* (or alternatively the supply cable 110*a*). Respective grooves 415*a,* 415*b* are formed transversely relative to the channels 410*a,* 410*b*. In addition to the U-shaped opening 257*h,* the metal blade 206*f* has a U-shaped opening 420 arranged transversely relative to the opening 257*h;* the metal blade 206*f* is fixed in the groove 415*a* of the half-shell 405*a* (with the opening 420 facing outwardly).

The insulating element 203*r* is constituted by a single body in which the cavities 267, the holes 278*a,* 278*b* (for the engagement teeth 254*a,* 254*b* disposed on a lateral surface of the insulating element 203*f*) and the blind hole 284 are formed. Two further blind holes 425*a,* 425*b* are arranged parallel to the blind hole 284 on opposite sides thereof; each of the blind holes 425*a,* 425*b* defines, in the cavity 267, an undercut portion complementary to the respective arm 290*a,* 290*b* of the metal blade 206*r*.

In an operative condition, the half-shell 405*a* is placed against the supply cable 115*a* previously separated (for example, by a screwdriver) from the support cable 120*a*. The half-shell 405*b* is inserted between the supply cable 115*a* and the support cable 120*a*. The insulating element 203*f* is then snapped shut irreversibly around the supply cable 115*a* and the opening 420 simultaneously cuts the insulating covering of the supply cable 115*a*.

The free end of the branch cable 212 is inserted fully into the blind hole 284. The metal blade 206*r* is press-fitted in the cavity 267 from below (by means of a suitable tool) until it cuts the insulating covering of the branch cable 212; at the same time, each of the arms 290*a,* 290*b* is snap-fitted in the corresponding undercut portion formed by the respective blind hole 425*a,* 425*b,* locking the metal blade 206*r* inside the cavity 267.

As in the previous embodiment, the insulating element 203*r* is fitted on the insulating element 203*f* and the engagement teeth 254*a,* 254*b* are snap-fitted in the holes 278*a,* 278*b;* at the same time, the main body 287 of the metal blade 206*r* is fitted in the opening 257*h* of the metal blade 206*f*. The insulating element 203*r* can be withdrawn (pulling with it the metal blade 206*r* firmly fixed thereto) simply by releasing the engagement teeth 254*a,* 254*b* from the holes 278*a,* 278*b*.

This structure is extremely compact and thus very advantageous for the connection of electrical devices of limited size. Moreover, the insulating element, which remains closed around the supply cable should the electrical device be removed, is extremely small and does not therefore adversely affect the appearance of the suspended electrical system as a whole. It should be noted, however, that the above-described connector cannot be used to support the electrical device on the cable structures (but only for its electrical connection) and should therefore always be housed inside the load-bearing structure thereof.

Naturally, in order to satisfy contingent and specific requirements, an expert in the art may apply to the above-described connector many modifications and variations all of which, however, are included within the scope of protection of the invention as defined by the following claims.

What is claimed is:

1. A connector of the insulation-perforating type for a suspended electrical system, comprising:

a. conductive means for cutting an insulating covering of an insulated supply cable in order to connect an electrical device electrically to an uncovered portion of the supply cable, the conductive means comprising a first conductive element connected electrically to the uncovered portion of the supply cable and a second conductive element connected electrically to the electrical device, the first and the second conductive element being housed, respectively, in a first cavity of the first insulating element and in a second cavity of the second conducting element, in order to be protected from manual contact, one of the first conductive element and the second conductive element being fitted in the corresponding cavity of the other conductive element in order to contact the other conductive element; and, b. an insulating structure for enclosing the conductive means, the insulating structure comprising a first insulating element which can be closed around the supply cable in a non-reversible manner in order to protect the uncovered portion from manual contact, and a second insulating element which can be connected to the electrical device and which can be joined reversibly to the first insulating element, the first insulating element comprising means for preventing sliding along the supply cable.

2. A connector according to claim 1, in which a distance between each conductive element and any point accessible manually from the exterior is greater than an enhanced insulation value.

3. A connector according to claim 1 or claim 2, in which the second insulating element includes an inner insulating element and an outer insulating element, the second cavity being formed in the inner insulating element, and in which the inner insulating element has a first opening for access to the second cavity, the second conductive element being fitted in the second cavity through the first opening and the outer insulating element being disposed around the first opening, and in which the outer insulating element has a second opening for access to the second conductive element for housing a free end of an insulated branch cable of the electrical device, the second conductive element being suitable to cut an insulting covering of the branch cable in order to be connected electrically to an uncovered portion thereof.

4. A connector according to claim 1 or claim 2 in which the insulating structure includes at least one engagement tooth and at least one corresponding hole for snap-connecting the second insulating element to the first insulating element and at least one resilient element which is suitable to be fitted in the at least one corresponding hole, the at least one resilient element cooperating with the at least one engagement tooth in order to release the at least one engagement tooth manually for the at least one hole.

5. A connector according to claim 1 or claim 2 in which the first insulating element includes a first insulating unit and a second insulating unit which are joined together around the supply cable, first snap means for temporarily joining the second insulating unit to the first insulating unit, and second snap means for finally joining the second insulating unit to the first insulating unit.

6. A connector according to claim 5, in, which the supply cable is included in a suspended cable structure, the first insulating unit comprising cutting and opening-out means for separating the supply cable from a remaining portion of the cable structure in the vicinity of the uncovered portion.

7. An electrical device for use in a suspended electrical system having a first cable structure and a second cable structure each comprising at least one supply cable the electrical device being electrically connected to a supply cable of each cable structure by means of the connector according to claim 1 or claim 2 and having a load-bearing structure comprising the second insulating element of each connector for supporting the electrical device on the first cable structure and on the second cable structure.

8. A suspended electrical system comprising at least one electrical device according to claim 7, and a first suspended cable structure and a second suspended cable structure for supplying and supporting the at least one electrical device.

9. A method of connecting an electrical device in a suspended electrical system employing the connector of claim 1, comprising the step of cutting an insulating covering of an insulated supply cable by conductive means of a connector of the insulation-perforating type, the method being characterized by the steps of: closing a first insulating element around the supply cable in a non-reversible manner in order to protect an uncovered portion of the supply cable from manual contact, the first insulating element comprising means for preventing sliding along the supply cable, connecting a second insulating element to the electrical device, joining the second insulating element to the first insulating element in a reversible manner in order to connect the electrical device electrically to an uncovered portion of the supply cable by the conductive means and to enclose the conductive means in the first insulating element and the second insulating element.

10. A connector of the insulating-perforating type for a suspended electrical system comprising a conductive means for cutting an insulating covering of an insulated supply cable in order to connect an electrical device electrically to an uncovered portion of the supply cable, and an insulating structure for enclosing the conductive means, the insulating structure comprising:

a. a first insulating element which can be closed around the supply cable in a non-reversible manner in order to protect the uncovered portion from manual contact, the first insulating element comprising means for preventing sliding along the supply cable; and b. a second insulating element which can be connected to the electrical device and which can be joined reversibly to the first insulating element, wherein the conductive means includes a first conductive element connected electrically to the uncovered portion of the supply cable and a second conductive element connected electrically to the electrical device, the first conductive element being suitable to contact the second conductive element and being housed in a cavity of the first insulating element in order to be protected from manual contact.

* * * * *